United States Patent [19]

O'Brien

[11] 4,164,352

[45] Aug. 14, 1979

[54] GOLF SWING PRACTICE MAT

[76] Inventor: John P. O'Brien, 175 E. Delaware Pl., Chicago, Ill. 60611

[21] Appl. No.: 872,377

[22] Filed: Jan. 26, 1978

Related U.S. Application Data

[63] Continuation-in-part of Ser. No. 834,293, Sep. 19, 1977, Ser. No. 780,271, Mar. 23, 1977, Ser. No. 753,927, Dec. 23, 1976, and Ser. No. 735,761, Oct. 26, 1976, Pat. No. 4,081,918, said Ser. No. 834,293, is a continuation-in-part of Ser. No. 661,779, Feb. 26, 1977, abandoned, said Ser. No. 753,927, is a continuation-in-part of Ser. No. 683,898, May 6, 1976, abandoned.

[51] Int. Cl.[2] ..... A63B 69/36

[52] U.S. Cl. ..... 273/187 A; 273/195 A; 273/187 B

[58] Field of Search ..... 273/187 R, 187 A, 187 B, 273/32 C, 183 A, 188 R, 188 A, 195 R, 195 A

[56] References Cited

U.S. PATENT DOCUMENTS

| | | | |
|---|---|---|---|
| 1,484,390 | 2/1924 | Gibbs et al. | 273/187 A |
| 2,189,613 | 2/1940 | Paulsen | 273/187 R |
| 3,363,903 | 1/1968 | O'Brien | 273/187 B |
| 3,510,135 | 5/1970 | Gentile | 273/187 A X |
| 3,801,108 | 4/1974 | Murray | 273/187 A X |
| 3,868,109 | 2/1975 | Fowler | 273/187 A |
| 4,000,905 | 1/1977 | Shirhall | 273/187 A |

FOREIGN PATENT DOCUMENTS

| | | | |
|---|---|---|---|
| 1305710 | 2/1973 | United Kingdom | 273/187 R |

*Primary Examiner*—George J. Marlo
*Attorney, Agent, or Firm*—Cook, Wetzel & Egan, Ltd.

[57] ABSTRACT

A training mat for golfers includes an area of artificial grass from which a teed golf ball may be driven, and a foot placement area on which the golfer stands. The mat contains diverse marking which enable a golfer to properly position his feet and the golf ball when using the different clubs of a set. A foot supporting wedge may be pivotally mounted on the foot placement area to support the golfer's rear foot.

8 Claims, 4 Drawing Figures

GOLF SWING PRACTICE MAT

This application is a continuation-in-part of my copending patent application Ser. No. 834,293 filed Sept. 19, 1977 (which is a continuation-in-part of Ser. No. 661,779 filed Feb. 26, 1977, now abandoned); Ser. No. 780,271 filed Mar. 23, 1977; Ser. No. 753,927 filed Dec. 23, 1976 (which is a continuation-in-part of Ser. No. 683,898 filed May 6, 1976, now abandoned); and Ser. No. 735,761 filed Oct. 26, 1976 now U.S. Pat. No. 4,081,918, issued Apr. 4, 1978.

The present invention relates to a golf training device in the form of a mat without moveable permanent parts adapted to be used by a golfer in practicing his golf swing. The golf practice mat of the present invention provides an area for foot placement and an imitation grass area from which a golf ball may be struck. More particularly, the golf training device of the present invention provides indicia which show the proper foot placement for the golfer. The proper foot placement involves many factors, including the proper spacing of the feet from each other and the angles of the feet with respect to each other, the proper spacing of the feet from the ball, the proper alignment of the feet with respect to the intended line of flight of the ball and the proper lateral placement of the feet with respect to the position of the ball. All of these factors are taken into account by the present golf training device.

In addition to the foot placement indicia, the golf training device of the present invention includes a hitting area which includes an artificial grass surface. This is particularly important because it provides golfers in the northern climates an opportunity to practice during winter months or inclement weather using conventionally available or commercially available mats. Importantly, the golf mat of the present invention is designed so that the point of impact of the club against the ball (and sometimes against the mat) will occur at a different location within the artificial grass area depending upon the club being used, thus distributing the wear uniformly across the grass area.

Finally, the present invention embodies a removable wedge-shaped device adapted to cant the rear foot and leg, i.e., the foot farthest from the intended target, toward the target in order to teach the user proper foot and leg action during the golf swing. The mat can be used during golf swing practice with or without this device.

The problem of swaying to the rear on the rearward leg and away from the golf ball, during the back swing is a most common and consistently fatal error committed by average golfers, and particularly high handicap golfers. Swaying on the rearward leg sends golf scores sky rocketing, frustrating the efforts of potential golfers to play an improved game of golf. Weekend golfers typically worry about their grip, keeping their head steady and other factors, but few such golfers know or comprehend what their body should do, during the backswing and during the downswing, from the hips on down through the legs and the feet. In the case, for example, of righthanded golfers, not many, if any, high handicap golfers realize or are in a position to know that the right leg is the foundation of a fundamentally sound golf swing. The right leg, when positioned correctly through foot, ankle, and knee action during the backswing, set the hips on a horizontal platform which permits the shoulders, with a straight left arm, to rotate around a steady neck hub maintaining body balance over the ball. It is this correct action and position of the right leg during the backswing which triggers the weight shift on the downswing to the left foot, an inside-out swing at impact of the ball, a natural follow-through which provides a sound swing, and ultimately lower golf scores.

Millions of golfers who own the finest of golf equipment, through lack of insight, are unable to use that equipment and enjoy improved rounds of golf because of sway problems. Applicant's copending applications describe various types of devices adapted to be affixed to golf and other shoes and particularly the rear foot for the golfer, i.e., the foot farthest away from the intended target, in order to cant the golfer's foot, forcing him to position his right leg properly keeping most of his weight on the inside edge of his foot. Experience has demonstrated that forcing the golfer to keep most of this weight on the inside edge of his rear foot, or at least preventing him from placing a substantial fraction of his weight on the outside edge of the rear foot, that the tendency of the golfer to sway on his rearward leg away from the ball during the backswing can be significantly diminished.

It has been recognized by golfers, and particularly golf instructors or golf teaching professionals that the tendency to sway "off the ball," away from the intended target, can be reduced if a golfer's rearward foot (the foot farthest from the intended target) is canted or tilted toward the target which angles or positions the right leg properly and causing the weight placed on this foot to move to the inside edge of the foot. The canting of the rear foot and leg toward the target also tends to keep the golfer's weight equally distributed between the rear foot and the front foot and with practice serves as a remainder to the golfer to avoid swaying "off the ball" during the backswing.

It is theorized that canting the rear foot and right leg toward the target will allow a golfer to transfer as much as 60 or 70% of his weight to the inside edge of his rear foot, but at the same time a substantial portion of the golfer's weight will remain on the front foot throughout the entire swing including the top of the backswing. Canting the rear foot toward the target positions the right leg and forces the golfer to keep his weight on the inside edge of his foot and thus reduce the chances that the golfer will move his right leg rearward swaying and transfers all of his weight to the rear foot. When the golfer's weight is thus distributed by correct right leg and foot positioning at the top of his backswing, i.e., no more than about 70% of his weight on the rear foot, he is automatically or naturally able to shift his weight to the front foot during the downswing, at the same time maintaining a steady head position "over the ball."

Many devices have been devised by the prior art in order to accomplish the canting of the rear foot and leg toward the target. Some golf teaching professionals simply suggest that their pupils place a golf ball under the outside edge of the rear foot. While such an expedient can be used, every time the golfer wishes to reposition his rear foot, it is necessary to reposition the golf ball under his shoe.

The prior art has suggested the use of golf shoes wherein one or both of the shoes are canted inwardly. For example, one U.S. patent suggests that the rear foot be equipped with a shoe which is canted toward the target. However, this patent describes a shoe which is permanently raised along its outer edge. While this might achieve some of the objectives of the present invention, insofar as giving the golfer the feel of the correct golf swing, such shoes are not adapted to be used as an ordinary street shoe or as ordinary golf shoes. Further, walking substantial distances with one shoe canted would probably be uncomfortable and might cause various orthopedic problems.

Applicant's U.S. Pat. No. 3,218,734 describes a removable supporting attachment for golf shoes, wherein the removable support is adapted to be affixed to a specifically designed spike or cleat in a golf shoe, which is inserted in the golf shoe for the purpose of holding the support attachment. While this device was successful in giving a golfer the correct feel of a proper swing, and leg-foot action, and had the advantage of being removable, the means for attaching the supporting device required for use of a special spike or cleat which had certain inherent limitations. As a practical matter, the device of U.S. Pat. No. 3,128,734 was not readily usable with ordinary street shoes or sport shoes other than golf shoes.

Applicant's copending application Ser. No. 834,293 filed Sept. 19, 1977, describes a golf training device adapted to be removably affixed to a golf shoe, wherein an annular magnet holds the training device to the flange of a standard golf spike which is mounted on a golf shoe. While the device as described, shaped and claimed in the copending application has many desirable attributes, it is not adapted to be used on shoes other than golf shoes which are fitted with conventional spikes and intended for use off of natural grass.

Applicant's other copending patent applications including Ser. No. 735,761 filed Oct. 26, 1976; Ser. No. 753,927 filed Dec. 23, 1976; and Ser. No. 780,271 filed Mar. 23, 1977, provide wedge-shaped golf training devices adapted to be removably affixed to different types of shoes which need not be golf shoes per se. Since a great deal of golf practice is conducted at driving ranges which are open to the public, it is important to provide a training device which may be used with shoes adapted to be used for ordinary purposes. Many of the customers at such driving ranges are not equipped with golf shoes, but are wearing street shoes or sport shoes of various configurations not equipped with golf spikes. The golf training devices of te aforesaid patent applications may be affixed to conventional sport or leisure shoes which are produced or suitably modified to mate with golf training device. All of these devices are adapted to give a golfer the correct feeling of foot and leg placement, and thus contribute to proper use of the legs during a golf swing. As was mentioned above, the ultimate objective of these devices is to keep the right leg flexed and angled towards the target, keeping the hips horizontal, which in turn promotes a good golf swing with the head kept in a fixed position above the golf ball and the weight being naturally shifted from the rear foot to the front foot during the downswing.

The foregoing prior art devices are aimed at assisting the golfer in learning or practicing the dynamics of a proper golf swing. While these prior art devices have been successful in this function, the present invention is aimed at teaching the golfer the static aspect, i.e., setup as an integrated portion of the whole golf swing. It is the objective of the present invention to provide the golfer with indicia which show the proper placement of the feet. Proper placement of the feet is the first step is establishing proper set up of the golfer over the golf ball. If the golfer is not properly set up over the golf ball, it is unlikely that he will be able to execute a proper golf swing on a regular basis, irrespective of how he performs the dynamic aspect of the swing.

Because a correct golf stance is necessary to properly execute golf shots, and because a primary factor in assuming the correct stance is placement and location of the feet with respect to each other, with respect to the ball, and with respect to the line of flight intended of the ball, the first aspect of the training device of the present invention is the feet placement indicia.

In analyzing the factors involved in foot placement, it is necessary to determine relative height of the golfer, his length of arms, as well as the golf club being used (since the length of the shaft of various golf clubs differ one from another) in order to provide proper spacing between the golfer's feet and the ball. It is also necessary to have foot placement or locations for both the right and left feet of the golfer as to the proper spacing between his feet, as well as the relative angles for each foot with respect to the line of flight. Further, it is necessary to have proper placement of the feet with respect to line of flight indicator line, so the golfer can tell whether his stance is open, normal, or closed. Finally, the relative placement of the golf ball relative to the golfer's left heel must be determined. Through a combination of indicators, the golf mat of the present invention provides the golfer with indicators as to each of these four factors so that the golfer can achieve appropriate stance based on his height and based on the golf club he is using. Additionally, the present invention is designed to cause the golf ball-golf club impact point to shift within the hitting area, depending upon the golf clubs used, in order to distribute the wear of the golf mat over a substantial area rather than a given single point.

It is generally known that different golf stances are required for the proper use of different golf clubs, i.e., those clubs with shorter shafts generally require the golfer to stand closer to the golf ball, and generally it is considered good practice to use the clubs with the shorter shafts with a narrower stance, i.e., that is the golfer's feet are closer together when the golf ball is struck. The present invention adapts the varying stances of the golfer in that varying foot placement positions are provided, while at the same time, assists in shifting the point of the golf club-ball impact point on the hitting surface from one point to another, as the golfer switches from one club to another, and thus distributes the wear of the golf mat over a greater area.

The golf training mat of the present invention comprises a foot placement area and a hitting area, wherein the placement area contains indicia which provide a golfer with information to correctly place and align his feet, which in turn assist the golfer in aligning his hips and shoulder with the direction target so that he can swing the golf club in the correct direction and achieve inside-out swing at impact with the ball. The present invention also contemplates the use of a removable wedge-shaped device, adapted to be removably affixed to the golf training mat in the foot placement area and cooperate with the foot placement indicia and thus the present invention provides a golfer with a canted foot placement of the same sort as is described in the prior art, through the use of a specially designed moveable, removable wedge-shaped device so that the golfer can feel and learn the proper leg movement during the golf swing. Because of the mat configuration, and the removable capability of the wedge-shaped device, the golf training mat of the present invention may be used at golf driving ranges, at home, or may be used by other golf teaching institutions.

Still further the golf training mat of the present invention comprises a grassy-like, artificial grass area, from which the golf ball may be struck, thus enabling the golfer to practice with all of his golf clubs, including both woods and irons.

As is hereinafter explained, through the use of the wedge-shaped device on the right foot placement indicator line, the golfer can, in addition to achieving the correct location of his feet and hence a correct setup, achieve a proper feel of the weight balance as between the two feet, whereby the golfer would be urged into a proper hitting position during the dynamic portion of the backswing and throughout the entire golf swing.

The foregoing advantages of the present invention will become apparent upon consideration of the following description, including the illustrative embodiments, taken in conjunction with the accompanying drawing in which.

Figure 1:
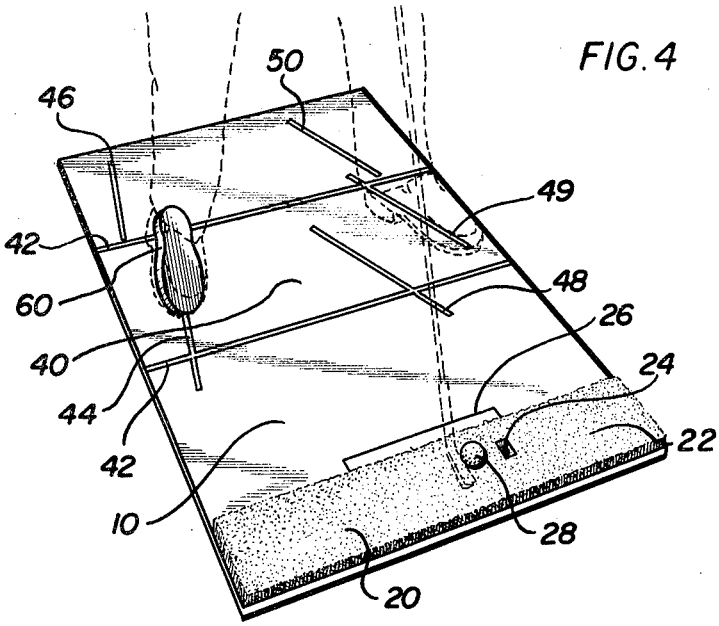
FIG. 1 is a perspective view of the golf swing practice mat of the present invention showing it in use.
Figure 2:
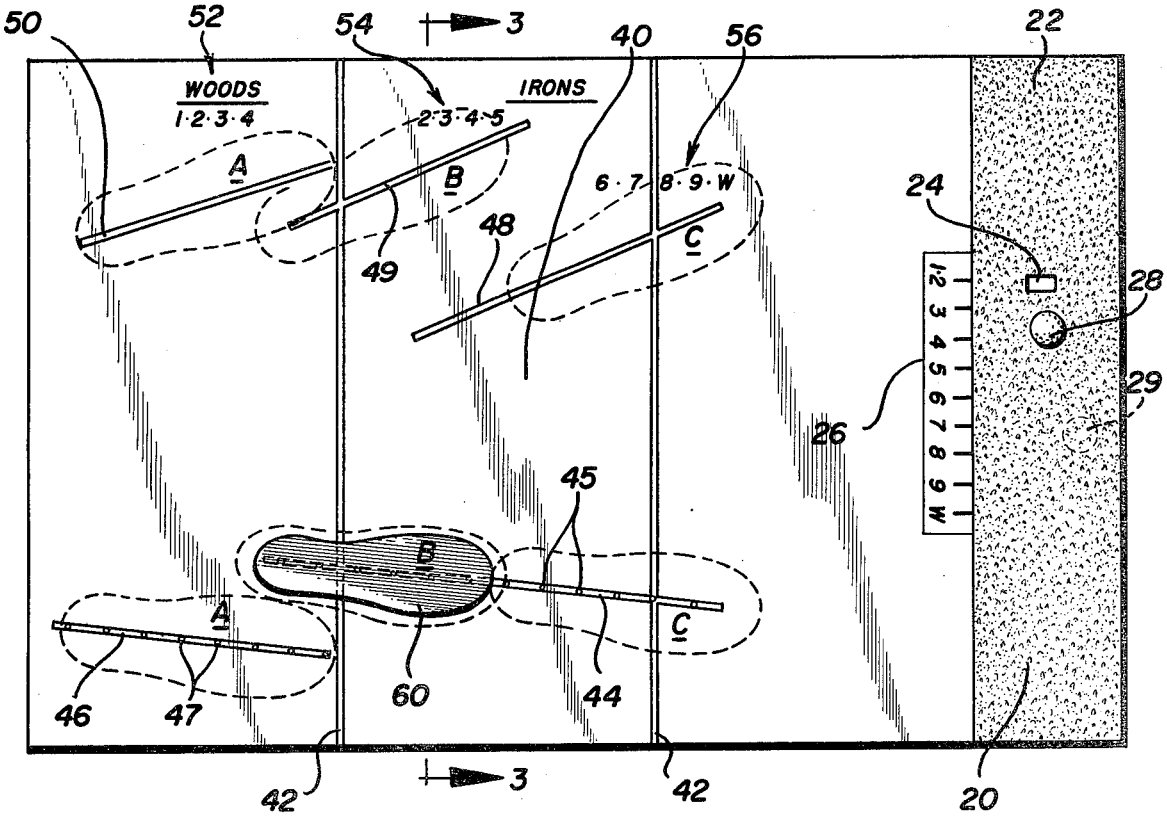
FIG. 2 is a plan view of the golf swing practice mat of the present invention.
Figure 3:
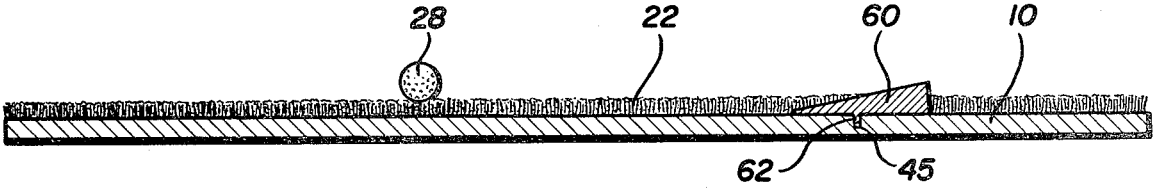
FIG. 3 is a vertical cross-sectional, side view of the golf swing practice mat, taken along line 3—3 of FIG. 2.

Turning to the drawing, and particularly FIGS. 1 and 2, the golf training mat 10 generally comprises a ball placement or hitting area 20 and a foot placement zone or area 40. Preferably the hitting area extends the width of the mat, i.e., from the edge closest to the target to the edge farthest from the target, and it can be extended to reach to the beginning of the foot placement zone, although smaller areas may be used. Preferably the hitting area is covered by a grass-like artificial grass surface 22, of the type commercially available as Astroturf or the like. Alternatively, brush-like devices may be used.

In addition to the grass area 22, a teeing position 24 is also provided within hitting area 20. The teeing position 24 may comprise a piece of vertically disposed rubber tubing adapted to hold the ball above the surface of the grassy area 22, or, alternatively, the teeing position may comprise plastic or granular composition adapted to receive conventional wooden tees of the type as are used in playing golf.

The hitting area 20 also includes a ball placement index 26, which indicates to the golfer the proper lateral placement of the golf ball with respect to the position of the golfer for using different golf clubs. It is generally recommended that the golf ball be positioned opposite the golfer's left heel for shots with the driver, but that the golf ball should gradually be moved to the right (relative to the golfer) as the shorter clubs are used. It is generally recommended that the short irons, for instance, be played with the golf ball laterally centered between the two feet of the golfer. Preferably, index 26 shows a hitting position for woods as well as irons. As is illustrated in FIGS. 1 and 2, the index 26 may show the ball position for the one or two wood, a three wood or three iron, four wood or four iron, five wood or five iron plus the six, seven, eight and nine irons and wood. A greater or lesser numbers of ball placement positions may be included in index 26, depending upon the material from which it is constructed. The ball placement index 26 may be located on the side of the hitting area toward the golfer, as is shown in FIG. 1 and 2, or it may be on the outside, i.e., whereby the golf ball is between the index and the golfer.

The foot placement zone 40 includes at least one line of flight indicator 42 which is, in effect, a line parallel to the actual (or intended) line-of-flight of the ball. Preferably, the foot placement zone 40 includes two line of flight indicators 42 as is shown in FIG. 2, although a greater number of flight indicators may be used. The line-of-flight indicators 42 are considered to be essential because they help a golfer to correctly place his feet with respect to the intended line of flight of the ball. Thus line-of-flight indicator lines 42 will show the golfer whether his stance is open, closed or normal.

Located within the foot placement zone 40 is the right foot placement indicia. The right foot placement indicia preferably comprises a plurality of lines, of the type shown in FIG. 2 as lines 44 and 46 which indicate to the golfer the line along which his right foot should be placed. As is explained below, right foot placement lines 44 and 46 may be positioned more or less normal to line-of-flight indicator lines, but it is preferred that these lines be positioned at an acute angle to the line-of-flight indicator line 42, as is shown in FIG. 2, whereby the right foot will be aimed somewhat to the right of a line normal to the line-of-flight indicator line 42.

Preferably the right foot placement lines 44 and 46 cooperate with stance indicators 52, 54 and 56 to advise the golfer of the exact recommended placement of his right foot for any given golf club, i.e., this gives the golfer an indication of the approximate distance between the ball and his feet. Preferably the stance indicator means is divided into three segments, 52, 54 and 56 as is shown in FIG. 2, although they may be combined if desired. The combination of the right foot placement lines 44 and 46 with the stance indicators 52, 54 and 56 instruct the golfer exactly where to position his right foot. When the right foot is correctly placed, the line-of-flight indicator lines 42 show the correct placement of the left foot and thus inherently gives the golfer the correct spacing between the golf ball in the hitting area and the golfer's feet.

The foot placement zone 40 preferably also includes left foot placement lines of the type illustrated as lines 48, 49 and 50 in FIG. 2. It is preferred that left foot placement lines be aligned somewhat to the left of normal to the line-of-flight indicator 42, as is shown in FIG. 2. It is contemplated that the primary function of left foot indicator lines is to illustrate to the golfer the correct alignment of his foot and to give him the proper spacing between his feet for one or two selected golf clubs, with the understanding that the actual spacing between his feet will vary significantly depending upon the particular golf club being used. For instance, the left foot placement lines 48, 49 and 50 may be designed to cooperate with the stance indicators 52, 54 and 56 to give the appropriate location of the left foot for a given golf club. As was mentioned above, it is generally advocated that the feet be approximately the width of the golfer's shoulders for shots with a driver, but that as the golf clubs with shorter shafts are used, the feet be gradually placed closer together. Generally with sand wedge or pitching wedge it is recommended that the feet be only 6 to 8 inches apart, measured at the heels.

Right foot placement indicia, as illustrated by lines 44 and 46, are provided with a plurality of openings or holes 45 and 47 extending vertically into the mat, which holes are adapted to receive pin 62 of wedge device 60 more fully described below. Holes 45 and 47 preferably describe a plurality of lines, coincident with foot placement lines 46 and 44. Holes 45 and 47 cooperate with stance indicators 52, 54 and 56 to show the golfer exactly the position of the right foot, for any given golf club.

Figure 4:
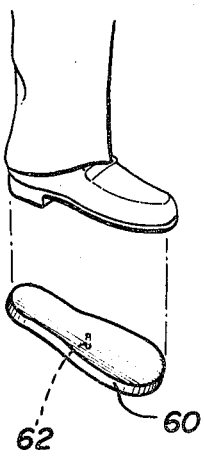
FIG. 4 is an isometric view of the wedge-shaped device adapted for use in conjunction with the golf swing practice mat of the present invention, showing a golfer's shoe disposed above the wedge.

The golf swing practice mat of the present invention also includes a wedge device 60, shown in FIG. 4, adapted to cant the rear (right foot in the case of a right-handed golfer) foot and leg of a golfer. As is shown in FIG. 4, wedge device 60 is preferably shaped (plan view) in the general outline of a shoe sole, and has the outside edge elevated, preferably about one inch high whereby a foot placed on the wedge 60 is canted inwardly toward the target at approximately 30°. Pin 62 extends from beneath wedge 60 and is adapted to cooperate with holes 45 along foot indicia 44 or holes 47 along indicia 46. The wedge may be constructed of wood, plastic, rubber, or metal, but preferably has a non-slip upper surface. Further, the upper surface may be covered with a tough rubbery material which will permit golfers wearing golf shoes with conventional or modified spikes to use the wedge device.

In the preferred embodiment, the pin 62 is centrally located beneath wedge 60 whereby the alignment of the wedge and hence the golfer's foot placed on the wedge may be varied with respect to its angle of intersection of the line of flight. While many golf instructors advocate that the right foot be approximately at right angles or normal to the line of flight, other instructors suggest that the right foot be pointed somewhat to the right of normal to the line of flight as is shown in FIGS. 1 and 2. The wedge-shaped device of the present invention, being provided with the central pin, can be pivoted to provide any desired angle with respect to the placement of the foot. This provides a certain flexibility with respect to teaching golf whereby the instructor may set the wedge at the angle he desires the student to use.

The golf training device of the present invention includes indicia for the left foot, 48, 49 and 50, as is illustrated in FIG. 2, which are preferably set an acute angle to a line normal to the line of flight, i.e., pointed somewhat to the left of the ball. While theories vary as to the correct angle to be used for the left foot (for righthanded golfers), most golf professionals actually employ left foot angles between 12° and 30° to the left of normal to the line of flight. There is a school of thought that advocates the left foot should be placed at right angles to the line of flight. Therefore, the golf training device of the present invention preferably includes lines 48, 49 and 50 which show the angle of about 18° left of normal preferred by most instructors. Alternatively the indicia may be removably affixed to the mat whereby the individual instructor can realign the indicia to the angle of his liking.

The rear foot (right foot in the case of right-handed golfers) is placed in any of the multiple locations along indicia 44 and 46 provided on the golf swing practice mat. Preferably the rear foot is placed on the wedge device 60 shown on FIG. 4 wherein the wedge device is placed in one of the holes 45 or 47 provided along rear foot line 44 or 46. The rear foot indicia holes 45 and 47 are spaced at various distances from the ball and the actual line of flight. This configuration causes the point of impact of the golf club and the golf ball to be varied as a different golf club is used.

The driver is the golf club which generally has the longest club shaft, and for practicing golf shots with the driver, or the number one wood, the feet of the golfer are approximately 28 inches from the golf ball (as measured from right angles of a line drawn across from the toe of one foot to the toe of the other foot). When clubs having shorter shafts are used, the golfer gradually moves closer to the ball. When the nine iron or wedges are used, the distance from the toes to the golf ball should be approximately 14 inches or less. Naturally these dimensions may be changed somewhat for golfers of greater or lesser than average size.

Similarly, when the golf clubs with the longest shafts are used, the distance between the feet should be greater than when the shorter golf clubs are used. For instance, when the driver, or number one wood is used, the difference between the feet, as measured by the distance between the heels should be approximately 20 inches depending on a golfer's height and reach. When the shorter clubs are used, such as the nine iron, pitching wedge, or sand wedge, the distance between the shoes or feet should be approximately 7 inches. Again, these dimensions will vary somewhat according to the size of the golfer.

Further consideration should be given to the angular placement of each of the feet with respect to the intended line of flight. Many professional golf instructors advocate that the rear foot should be at right angles to the line of flight in order to restrict the amount of turn the golfer can make during the backswing. Other golf instructors suggest that the angle of the rear foot be as much as 15° or 20° opened, i.e., pointed to the right of the square in the case of a righthanded golfer. Most golfing instructors advocate that the front foot should be angled toward the target somewhat, at an angle of about 20° as measured from a line perpendicular to the line of flight. Some professional golfers, for instance Chi-Chi Rodriquez, advocate that the front foot be placed at right angles to the line of flight, or in some cases turned inward (pointed to the right of the ball in a somewhat pigeontoed stance) which is said to give an improved release of the hand and body at the moment of impact.

The golf swing practice mat of the present invention contemplates that the angle placement of either foot can be adjusted according to the desires of the particular golf instructor or the particular golfer involved. The wedge device 60 used in connection with the present invention is attached to the mat through a single pin 62 arrangement, which enables the wedge to be pivoted, around a vertical axis, thus enabling the user to place his rear foot at any desired angle and still achieve correct placement of the foot (i.e., the proper distance from the ball) and the advantages of the wedge-shaped device to cant his rear foot into the desired position.

The foot placement zone illustrated by FIG. 2 is divided into a forward set of foot placement line 44 and 48 which are relatively close to the hitting area 20 and which are chiefly adapted for use in practicing irons, and particularly the "short iron" which typically have relatively short shafts. The pair of rear foot placement lines 46 and 50, are located further from the ball, and are adapted for practicing with woods and long irons which have relatively long shafts. The present inventon contemplates that the placement zone may be further subdivided into medium irons, long irons, short woods and the like or alternatively, may only have one right foot placement line and one left foot placement line. FIG. 2 illustrates the presently contemplated best mode.

The use of the golf training mat of the present invention is illustrated by FIG. 2, wherein the placement of a right foot is at position A, as shown by the dotted lines, along line 46 and the placement of the left foot at position A along line 50 demonstrate the correct position for a golfer to stand to practice swinging a driver. In this case, the ball should be placed at teeing position 24, opposite the indicia "1" on ball placement index 26.

Also shown in FIG. 2 is a pair of foot locations labeled B, shown by dotted lines, located along right foot line 44 and left foot line 49. The position shown by B is appropriate for practicing with a four iron, wherein the ball is placed at ball location 28.

Also shown on FIG. 2 is a pair of foot locations labeled C, shown by dotted lines, which include right foot placement along line 44 and left foot placement along line 48. The position illustrated by position C is suitable for practicing with an eight iron, wherein the ball would be placed at position 29.

The foregoing arrangement provides for substantial different foot placement on the mat with respect to the different classes of golf clubs being used, and as a result of the different foot placement, radially different ball placements, within the hitting area, are required. Because the ball is placed at different locations, depending upon the golf club being used, the wear on the grass surface 22 is distributed across a substantial area, thus prolonging the life of the golf training device.

It is contemplated that the golf training device of the present invention may be substantially in the form of a golf mat adapted for use in a golf driving range which may be either permanently located at the range area, or may be removable therefrom. It also may be used at home or at other places where golf lessons are given. The present invention contemplates a mat which is substantially planar and free from obstructions, thus providing a golfer with a hitting area which contains a tee means as well as a grass-like area, of artificial turf, simulating natural turf from which he can practice the iron shots which are necessary to a game of golf.

The golf mat may be made of any desired material, but tough rubber type materials are preferred. Rubbery surfaces are preferred because they permit use by golfers wearing conventional golf shoes, golf shoes with modified spikes or leisure or street shoes. The present invention contemplates a golf mat which employs a wedge-shaped device, moveably affixed to various points across the surface of the mat, adapted to receive a single pin from a wedge-shaped device used to cant the rear foot toward the target. Because the wedge-shaped device is adapted to engage the golf mat through pin 62, the mat need only have a series of holes to cooperate with the wedge-shaped device. The present invention contemplates that the holes illustrated as 45 and 47 may define a plurality of lines, e.g., 3 rows of holes, parallel to each other, designed to be used by golfers of differing sizes. That is, taller golfers would use the line of holes furthest from the intended target and thus employ a wider stance, while the line of holes closest to the target would be used by the shorter golfers and the middle row by average-sized golfers. In the absence of this device, the golf training mat of the present invention can be used as a standard mat at a driving range.

The forms of invention herein shown and described are to be considered only as illustrative. It will be apparent to those skilled in the art that numerous modifications mahy be made therein without departure from the spirit of the invention or the scope of the appended claims.

I claim:

1. A golf training device enabling a golfer to learn and practice a proper golf swing, said device comprising:

a mat including a hitting area and a foot placement area;

said hitting area including a teeing area and an artificial grass area surrounding said teeing area, said foot placement area including at least one line of flight indicator line; and a right (or rear) foot placement indicia, said line of flight indicator line being parallel with the intended line of flight of a golf ball to be struck, said right foot placement indicia comprising a plurality of holes in said mat, said holes arranged in a line approximately normal to or to the right of normal of said line of flight indicator at spaced distances from said hitting area;

a foot supporting wedge-shaped device, a centrally mounted pin dependent from said wedge-shaped device, said pin adapted to engage and cooperate with said holes comprising a portion of the right foot indicia in said mat, said wedge-shaped device adapted to cant a golfer's right foot toward the intended target.

2. A golf training device as described in claim 1, wherein said foot placement area comprises left foot placement indicia lines.

3. A gold training device as described in claim 1, wherein said foot placement area includes two line of flight indicator lines.

4. A golf training device as described in claim 1, wherein said hitting area includes a ball placement index, said ball placement index being located adjacent to said hitting area and extending parallel to said line of flight indicator lines, said indicator adapted to indicate the correct placement of the ball along the line of flight depending upon the particular golf club being used.

5. A golf training device as described in claim 1, wherein said foot placement area includes at least one stance indicator positioned normal to said line-of-flight indicators, said stance indicator adapted to show a golfer the correct distance between the ball and his feet, depending upon the particular golf club being used.

6. A golf training device as described in claim 5, wherein stance indicator is subdivided into indicators for woods, long irons, and short irons.

7. A golf training device as described in claim 1, wherein said right foot placement indicia comprises a plurality of holes in said gold mat, whereby said holes are arranged in a plurality of lines parallel to each other, and positioned approximately normal to the line of flight in the indicator line.

8. A golf training device enabling a golfer to learn and practice a proper golf swing, said device comprising:

a mat including a hitting area and a foot placement area, said hitting area being fabricated from artificial grass, adapted to support a golf ball when said ball is struck with a golf club, a tee position in said hitting area, said tee position adapted to support a golf ball above the height of the surface of said artificial grass surface;

at least one line-of-flight indicator line in said foot placement area, said line-of-flight indicator line lying parallel to the intended line of flight of a golf ball to be struck from said artificial grass;

a right foot placement indicator means comprising a plurality of indicia for marking different rear foot positions, adapted to be used with golf clubs of different shaft lengths;

a foot supporting wedge, said wedge adapted to co-operate with said right foot placement indicator to support the rear edge of said right foot of the golfer, at one of said right foot positions;

indicia for positioning said golfer's left foot whereby said golfer's feet are placed approximately parallel to said line of flight;

a ball placement index, parallel to said line of flight, said ball placement index providing indicia as to the lateral position of the golf ball for different golf clubs.

* * * * *

UNITED STATES PATENT OFFICE

CERTIFICATE OF CORRECTION

PATENT NO. : 4,164,352

DATED : August 14, 1979

INVENTOR(S) : JOHN P. O'BRIEN

It is certified that error appears in the above-identified patent and that said Letters Patent are hereby corrected as shown below:

Column 3, line 17, change "for" to --the--;
Column 3, line 45, change "te" to --the--;

Column 9, line 26, change "radially" to --radically--;

Column 10, line 33 (Claim 3), change "gold" to --golf--; and
Column 10, line 54 (Claim 7), change "gold" to --golf--.

Signed and Sealed this

*Fourth* Day of *December 1979*

[SEAL]

*Attest:*

SIDNEY A. DIAMOND

*Attesting Officer*

*Commissioner of Patents and Trademarks*